US006188212B1

(12) United States Patent
Larson et al.

(10) Patent No.: US 6,188,212 B1
(45) Date of Patent: Feb. 13, 2001

(54) LOW DROPOUT VOLTAGE REGULATOR CIRCUIT INCLUDING GATE OFFSET SERVO CIRCUIT POWERED BY CHARGE PUMP

(75) Inventors: Tony R. Larson; David A. Heisley; R. Mark Stitt; Rodney T. Burt, all of Tucson, AZ (US)

(73) Assignee: Burr-Brown Corporation, Tucson, AZ (US)

( * ) Notice: Under 35 U.S.C. 154(b), the term of this patent shall be extended for 0 days.

(21) Appl. No.: 09/560,972

(22) Filed: Apr. 28, 2000

(51) Int. Cl.[7] ..... G05F 1/40; G05F 1/56
(52) U.S. Cl. ..... 323/281; 323/274; 330/291
(58) Field of Search ..... 323/270, 273, 323/274, 280, 281, 303; 330/260, 291

(56) References Cited

U.S. PATENT DOCUMENTS

| | | | | |
|---|---|---|---|---|
| 4,779,037 | * | 10/1988 | LoCascio | 323/275 |
| 4,796,174 | | 1/1989 | Nadd | 363/60 |
| 4,908,566 | * | 3/1990 | Tesch | 323/280 |
| 4,945,444 | * | 7/1990 | Schwertlein et al. | 323/277 |
| 5,334,928 | * | 8/1994 | Dobkin et al. | 323/280 |
| 5,552,697 | * | 9/1996 | Chan | 323/282 |
| 5,563,501 | * | 10/1996 | Chan | 323/282 |
| 5,625,278 | | 4/1997 | Thiel et al. | 323/280 |
| 5,631,598 | | 5/1997 | Miranda et al. | 327/540 |
| 5,648,718 | | 7/1997 | Edwards | 323/274 |
| 5,675,241 | | 10/1997 | Teggatz et al. | 323/282 |
| 5,705,919 | | 1/1998 | Wilcox | 323/282 |
| 5,850,139 | | 12/1998 | Edwards | 323/280 |
| 5,852,359 | | 12/1998 | Callahan, Jr. et al. | 323/274 |
| 5,864,227 | | 1/1999 | Borden et al. | 323/280 |
| 5,886,570 | * | 3/1999 | Brokaw | 327/540 |
| 5,889,393 | * | 3/1999 | Wrathall | 323/282 |
| 5,909,109 | * | 6/1999 | Phillips | 323/277 |
| 5,929,617 | | 7/1999 | Brokaw | 323/280 |
| 5,939,867 | | 8/1999 | Capici et al. | 323/277 |
| 5,982,226 | | 11/1999 | Rincon-Mora | 327/541 |
| 6,005,374 | | 12/1999 | Tasdighi | 323/273 |
| 6,046,577 | * | 4/2000 | Rincon-Mora et al. | 323/282 |
| 6,087,816 | * | 7/2000 | Volk | 323/282 |

OTHER PUBLICATIONS

Unitrode UCCX83 LDO Voltage Regulator, Integrated Circuits, 12/94A.

SGS–Thomson–L4955 LDO Voltage Regulator, 2/14 no date.

* cited by examiner

*Primary Examiner*—Peter S. Wong
*Assistant Examiner*—Bao Q. Vu
(74) *Attorney, Agent, or Firm*—Cahill, Sutton & Thomas P.L.C.

(57) ABSTRACT

A low drop out voltage regulator includes an error amplifier (12) having a first input coupled to a first reference voltage ($V_{REF}$), a second input receiving a feedback signal, and an output (15) producing an output signal ($V_{AMPOUT}$). An output transistor (18) has a gate, a drain coupled to an unregulated input voltage ($V_{IN}$), and a source coupled to produce a regulated output voltage ($V_{OUT}$) on an output conductor (19). A feedback circuit (20,22) is coupled between the output conductor (19) and a reference voltage (GND) to produce the feedback signal. A capacitor (16) is coupled between the output (15) of the error amplifier and the gate (17) of the output transistor (18). A servo amplifier (24) has a first input coupled to a second reference voltage ($VV_{REF}$), a second input coupled to the output (15) of the error amplifier. A low current charge pump circuit (26B) supplies an output current into a supply voltage terminal of the servo amplifier. A variable reference voltage circuit (27) produces the second reference voltage ($VV_{REF}$) so as to increase the dynamic range of the voltage regulator. An output current sensing circuit (37) operates to produce a control signal (29) representative of the drain current of the output transistor (18), the variable reference voltage circuit (27) having an input coupled to receive the control signal (29).

26 Claims, 3 Drawing Sheets

LOW DROPOUT VOLTAGE REGULATOR CIRCUIT INCLUDING GATE OFFSET SERVO CIRCUIT POWERED BY CHARGE PUMP

BACKGROUND OF THE INVENTION

The invention relates to low drop out (LDO) voltage regulators, and more particularly to improvements therein which allow use of a smaller charge pump to generate a high voltage to be used in generating a high gate voltage on the gate of the output transistor to enable it to supply a predetermined load current; the invention also relates to improvements which preserve load transient response of LDO voltage regulators at low, usually unregulated input voltages.

FIG. 1 illustrates a low drop out voltage regulator which is believed to be the closest prior art. An unregulated power supply voltage $V_{IN}$ is applied by conductor 13 to the drain of an N-channel transistor 18. The source of transistor 18 is connected to output conductor 19 on which the regulated voltage $V_{OUT}$ is produced. The "drop out voltage" is the voltage between the drain and source of transistor 18, which is referred to as the "pass transistor", or simply the "output transistor". The gate of transistor 18 is driven by an error amplifier 12 having its (+) input connected to a precision, temperature-stable reference voltage $V_{REF}$. A voltage divider including resistors 20 and 22 is connected between $V_{OUT}$ and ground, and provides feedback by conductor 21 to the (−) input of error amplifier 12.

A problem faced by designers of LDO voltage regulators is how to get the voltage $V_{GATE}$ on conductor 17 large enough to turn on output transistor 18 hard enough to supply a specified output current at the specified minimum drop out voltage across transistor 18 when the unregulated supply voltage $V_{IN}$ is only slightly higher than the desired regulated output voltage $V_{OUT}$. The "worst case", i.e., lowest, value of the unregulated supply voltage $V_{IN}$ might be only a few tenths of a volt higher than the desired regulated value of $V_{OUT}$. Under these conditions, the value of $V_{GATE}$ required on conductor 17 to maintain the regulated value of $V_{OUT}$ by providing the needed output current $I_{OUT}$ might need to be a number of volts higher than the desired regulated value of $V_{OUT}$. That is, $V_{GATE}$ might need to be substantially higher than the unregulated value of supply voltage $V_{IN}$, because in many applications, especially battery powered applications, the unregulated supply voltage $V_{IN}$ might be only a few tenths of a volt above $V_{OUT}$.

The closest prior art approach to solving the above described problem is to use a charge pump circuit 26A (such as a capacitive voltage doubler circuit) to internally "boost" a voltage initially equal to a multiple of $V_{IN}$ in order to provide a high enough "boosted" supply voltage to error amplifier 12 to enable it to produce the needed high value of $V_{GATE}$. This requires charge pump circuit 26A of prior art FIG. 1 to supply a high current to error amplifier 12 in order to enable it to supply enough current to rapidly charge the very large capacitance of the gate electrode of output transistor 18 to the value of $V_{GATE}$ which is required in response to a rapid change in the load current drawn by load 35.

Unfortunately, it is very costly to provide a high current charge pump circuit 26A, because very large capacitors and switches are required to provide the voltage doubling necessary to provide the large current required by error amplifier 12. The problems associated with providing a high current charge pump as a power supply for the error amplifier include the need for a substantially larger amount of semiconductor chip area, introduction of switching noise in the voltage regulator, coupling of the noise to the regulated output voltage, and, in some cases, an increased number of package leads for connection to external capacitors. The easiest solution, from the designer's standpoint, has been to require the user to provide a second supply rail to the LDO regulator, but this has increased both the cost and the complexity to the user. This is not an acceptable solution for most customers.

As a practical matter, a charge pump that is implemented entirely on the same chip as an LDO voltage regulator will require a large die area to be able to supply enough current to power the error amplifier. Furthermore, as the current producing capability of the charge pump increases, so does the noise it generates and the area required for its capacitors and switches.

N-channel Power MOS transistors (MOSFETs) have been used instead of NPN transistors for an LDO output stage, and such MOSFETs have the advantage of not requiring the base current that is needed by an NPN output transistor. However, N-channel MOSFETs in an LDO voltage regulator require a substantial amount of transient current to charge their large gate capacitances in response to rapid variations in output current supplied to the load. The error amplifier driving an output N-channel MOSFET must supply this large transient current, which ultimately comes from the charge pump providing power to the error amplifier. The transient currents required by use of N-channel MOSFETs are usually larger than can be supplied by a practical, completely on-chip charge pump. If the current supplied to the error amplifier by the charge pump is too low, the error amplifier transient response to load current changes is too slow, and the overall LDO performance is unacceptable for many applications.

Furthermore, even if an on-chip charge pump can supply sufficient current to power the error amplifier in an LDO voltage regulator, the inherently noisy output characteristic of a charge pump is problematic. The output of a charge pump has significant high frequency ripple at the pump frequency, and additional noise is produced on the charge pump output when transient currents are drawn from its output capacitor, as occurs when there is a large transient in the load current supplied by an N-channel output MOSFET. It is difficult for the error amplifier to reject the high frequency noise, as the PSRR (power supply rejection ratio) of an amplifier is typically best at low frequencies and decreases at higher frequencies. Therefore, much of the charge pump ripple and noise is fed through the error amplifier and appears at the gate of the N-channel output transistor and consequently on the output voltage $V_{OUT}$.

It is well known that the gate voltage of an output transistor configured as a source follower in an LDO voltage regulator must undergo a large change if there is a large variation in the load current. The error amplifier driving the gate voltage therefore must have a sufficient output voltage range that it does not "saturate" into the power supply voltage of the error amplifier when responding to large load current transients. If the output of the error amplifier does saturate, the error amplifier "loses control" of the output transistor, which allows the LDO voltage regulator output $V_{OUT}$ to go outside of its specified range. In low voltage LDO voltage regulators, the dynamic range of the error amplifier is limited by the small error amplifier supply voltage, so the load current transient range of the regulator is too limited for many applications.

Because of the above problems, the closest prior art has been unable to provide gate drive for the pass transistor above the input rail for the error amplifier in any way other than to power the error amplifier from a supply voltage which is higher than the unregulated input voltage $V_{IN}$, as in the Unitrode UCCX83 and the SGS-Thomson L4955 LDO voltage regulators. In both the UCCX83 and the L4955, the error amplifier supply voltage is powered by a large on-chip charge pump.

SUMMARY OF THE INVENTION

Accordingly, it is an object of the invention to provide an improved LDO voltage regulator capable of supplying a predetermined maximum load current by means of a minimum sized output transistor.

It is another object of the invention to provide an inexpensive improved LDO voltage regulator having a large dynamic load current range.

It is another object of the invention to provide an improved LDO voltage regulator which is capable of supplying a predetermined maximum load current by means of a minimum sized output transistor, and which also has a large dynamic range.

It is another object of the invention to provide an improved LDO voltage regulator which has an output MOSFET connected as a voltage follower, and which also is capable of providing fast response to a large load current transient.

It is another object of the invention to provide an improved LDO voltage regulator including a servo amplifier powered by a charge pump without use of external capacitors or package leads.

It is another object of the invention to provide an improved LDO voltage regulator including a servo amplifier powered by a charge pump wherein essentially none of the noise generated by the charge pump is fed through to the regulated output voltage or to the unregulated input voltage.

Briefly described, and in accordance with one embodiment thereof, the invention provides a voltage regulator including an error amplifier (12), an output transistor (18), an offset capacitor (16), a feedback circuit (20,22), a servo amplifier (24), and a low current charge pump circuit (26B). The error amplifier (12) has a first input coupled to a first reference voltage ($V_{REF}$), a second input receiving a feedback signal, and an output (15) producing an output signal ($V_{AMPOUT}$). The output transistor (18) has a gate, a drain coupled to an unregulated input voltage ($V_{IN}$), and a source coupled to produce a regulated output voltage ($V_{OUT}$) on an output conductor (19). The feedback circuit (20,22) is coupled between the output conductor (19) and a reference voltage (GND), the feedback circuit producing the feedback signal. The capacitor (16) is coupled between the output (15) of the error amplifier and the gate (17) of the output transistor (18). The servo amplifier (24) has a first input coupled to a second reference voltage ($VV_{REF}$), a second input coupled to the output (15) of the error amplifier. The low current charge pump circuit (26B) supplies an output current into a supply voltage terminal of the servo amplifier. A variable reference voltage circuit (27) produces the second reference voltage ($VV_{REF}$) so as to increase the load current dynamic range of the voltage regulator. An output current sensing circuit (37) operates to produce a control signal (29) representative of the drain current of the output transistor (18) and/or the load current, the variable reference voltage circuit (27) having an input coupled to receive the control signal (29).

BRIEF DFSCRIPTION OF THE DRAWINGS

DETAILED DESCRIPTION OF THE PRFFERRED EMBODIMENTS

Figure 1:
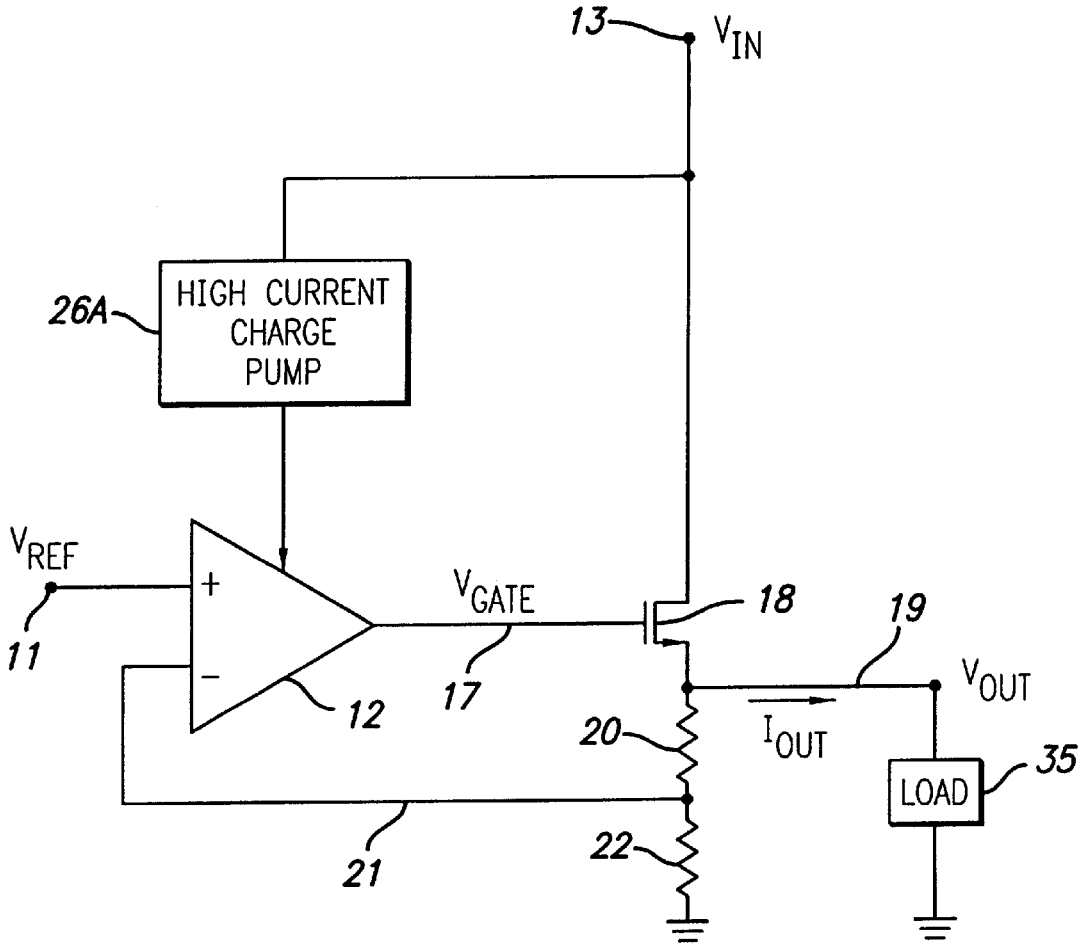
FIG. 1 PRIOR ART
FIG. 1 is a block diagram of the closest prior art.
Figure 2:
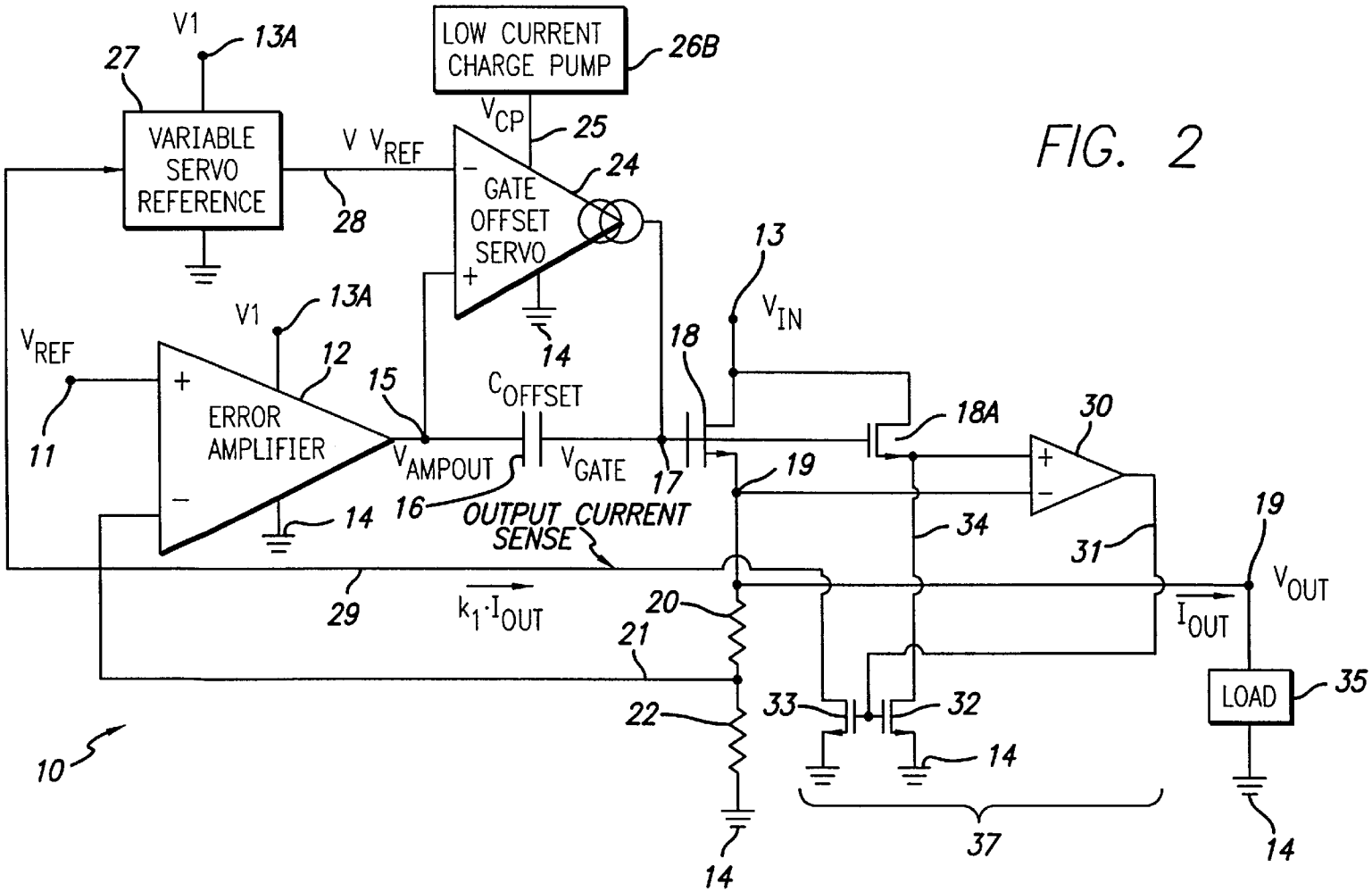
FIG. 2 is a block diagram of a preferred embodiment of the invention.

FIG. 2 is a diagram of an inexpensive, fast, low noise, high output entirely integrated circuit LDO voltage regulator 10 with large load current dynamic range which provides a practical solution to the above mentioned problems. N-channel output transistor 18 (which can be a DMOS device) of regulator 10 has its drain connected by conductor 13 to receive the unregulated input voltage $V_{IN}$. (Note that where appropriate, the same reference numerals are used in FIG. 2 as in prior art FIG. 1.) The source of output transistor 18 is connected to output conductor 19, on which an output voltage $V_{OUT}$ is produced across a load or circuit 35. Load 35 may demand an output load current $I_{OUT}$ that can rapidly vary anywhere between zero and a predetermined large value. Feedback from $V_{OUT}$ to the (−) input of error amplifier 12 is provided by a feedback circuit which includes resistors 20 and 22 connected in series as a voltage divider between $V_{OUT}$ and ground. The junction 21 between resistors 20 and 22 is connected to (−) input of error amplifier 12. The (+) input of error amplifier 12 is connected, by conductor 11 to receive a reference voltage $V_{REF}$, which can be fixed or variable.

The positive power supply terminal 13A of error amplifier 12 is connected to a voltage V1 on conductor 13A, which can be either $V_{IN}$ or an internally generated regulated or unregulated voltage. The other power supply terminal of error amplifier 12 is connected to ground. Error amplifier 12 applies an output voltage $V_{AMPOUT}$ on conductor 15 to one plate of an offset capacitor 16 having a capacitance $C_{OFFSET}$ and to the (+) input of a gate offset servo amplifier 24, which as implemented actually is an operational transconductance amplifier (OTA). The operational transconductance amplifier is hereinafter referred to simply as "servo amplifier 24". The other tenninal of offset capacitor 16 is connected by conductor 17 to the gate of output transistor 18 and to the output of servo amplifier 24. Servo amplifier operates to maintain a suitable offset voltage across capacitor 16.

Figure 3:
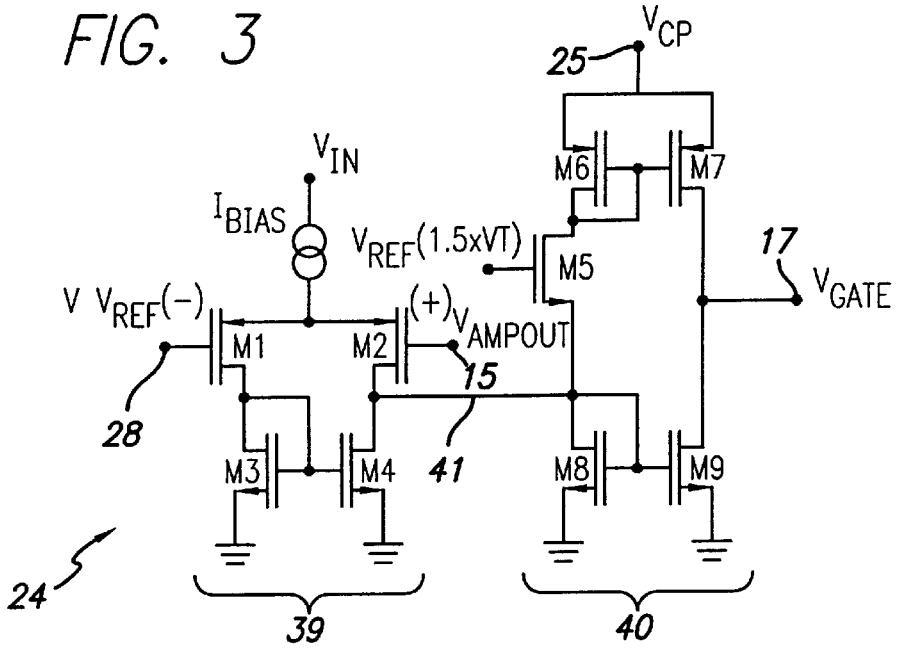
FIG. 3 is a schematic diagram of the servo amplifier in block 24 of FIG. 2.

Note that servo amplifier 24 is powered by having its supply voltage terminal 25 connected to a boosted internal supply voltage produced by a low current, entirely on-chip charge pump circuit 26B and the other power supply terminal of servo amplifier 24 is connected to ground conductor 14. The details of servo amplifier 24 are shown in FIG. 3.

Figure 4:
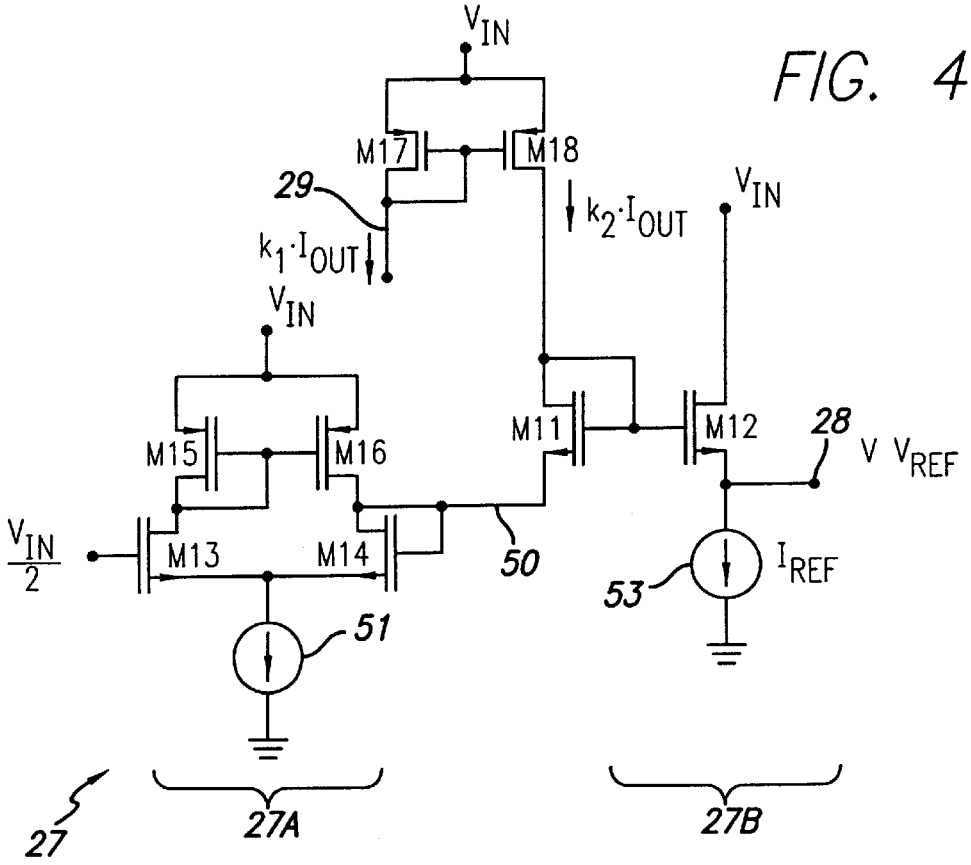
FIG. 4 is a schematic diagram of the variable reference voltage circuit in block 27 of FIG. 2.

In accordance with one aspect of the present invention, the (−) input of servo amplifier 24 receives a variable reference voltage $VV_{REF}$ which is produced on conductor 28 by a variable reference circuit 27. One power supply terminal of variable reference circuit 27 is connected to V1, and the other power supply terminal of variable reference circuit 27 is connected to ground conductor 14. A control input of variable reference circuit 27 is connected by conductor 29 to the output of a current sensor circuit 37. The details of variable reference circuit 27 are shown in FIG. 4.

Referring to FIG. 2, a current sensor circuit 37 includes an N-channel current sensor transistor 18A having its gate connected to conductor 17, its drain connected to $V_{IN}$, and its source connected by conductor 34 to both the (+) input of a differential amplifier 30 and the drain of an N-channel current mirror input transistor 32 having its source connected to ground. The (−) input of amplifier 30 is connected to $V_{OUT}$. The output of amplifier 30 is connected by conductor 31 to the gate electrode of current mirror input transistor 32 and to the gate electrode of an N-channel current mirror output transistor 33 having its source connected to ground. The drain of transistor 33 is connected by conductor 29 to the control input of variable reference circuit 27.

Current sensor circuit 37 operates as follows. Differential amplifier 30 drives the gate of transistor 32 such that its drain current, which also flows through the source of current sensor transistor 18A, causes the voltage of the source of current sensor transistor 18A to be equal to the source voltage $V_{OUT}$. The channel-width-to-channel-length ratio of current sensor transistor 18A is chosen to be approximately 1000 times less than that of output transistor 18, so the source current of current sensor transistor 18A is one 1000th of the source (and drain) current of output transistor 18, which is essentially equal to $I_{OUT}$ if the current through resistors 20 and 22 is negligible, as ordinarily is the case. The source current of current sensor transistor 18A is mirrored by transistors 32 and 33 to provide an input current to the control terminal 29 of variable reference circuit 27.

The new elements which have been added to the prior art circuit of FIG. 1 to obtain the circuit of FIG. 2 include above mentioned offset capacitor 16 and gate offset servo amplifier 24, which is powered by a small, entirely-on-chip charge pump 26B, wherein servo amplifier 24 operates so as to supply only enough charge into conductor 17 to maintain a suitable offset voltage across offset capacitor 16, wherein error amplifier 12 is powered by the power supply voltage V1. $VV_{REF}$ can be constant, or it can be variable in response to the output current $I_{OUT}$ supplied by transistor 18.

An important difference in the structure of FIG. 2 from that of prior art FIG. 1 is that error amplifier 13 does not receive its operating power from the output of the charge pump circuit as in prior art FIG. 1. Instead, the error amplifier 13 of FIG. 2 receives its power from the power supply voltage V1 on conductor 13A. This greatly reduces the amount of charge current required to be produced by low current charge pump circuit 26B, compared to the prior LDO voltage regulator shown in FIG. 1. This makes it practical to provide the entire low current charge pump 26B, including the voltage doubling capacitors, on the same integrated circuit chip as the rest of LDO voltage regulator 10.

The value of the voltage $V_{GATE}$ produced on conductor 17 and applied to the gate of output transistor 18 is the sum of the DC offset voltage across the offset capacitor 16 and the value of $V_{AMPOUT}$ produced by error amplifier 12. Only a small amount of charge is required from servo amplifier 24, and hence also from charge pump 26B, to maintain that offset voltage, because there is no DC path through which charge from offset capacitor 16 can be discharged.

Unlike prior art circuit 1, servo amplifier 24, and hence low current charge pump 26B, do not have to supply large amounts of charge during the typically short periods of time during which $V_{GATE}$ must change rapidly in response to a rapid change in the load current that might be suddenly demanded by the load circuit 35 across which regulated output voltage $V_{OUT}$ is maintained. Instead, if the output load current $I_{OUT}$ demanded by load circuit 35 changes rapidly, error amplifier 12 rapidly responds by changing $V_{AMPOUT}$ on conductor 15. The stored offset voltage across capacitor 16 causes $V_{GATE}$ to change according to the value $\Delta V_{AMPOUT}$ multiplied by $(C_{OFFSFT}/(C_{OFFSET}+C_{GATE}))$, where $C_{GATE}$ is the gate capacitance of output transistor 18. $V_{GATE}$ thus changes so as to cause output transistor 18 to restore and maintain the proper regulated value of $V_{OUT}$ applied to load circuit 35. Since servo amplifier 24 only needs to supply a very small amount of charge to replace any charge leakage from conductor 17, charge pump circuit 26B only needs be large enough to supply that small charge. Charge pump 26B therefore can be a relatively small circuit that can be easily included on the same integrated circuit chip as the rest of LDO regulator 10.

It should be noted that servo amplifier 24 is not included in the high frequency AC feedback loop controlled by error amplifier 12. That is, offset capacitor 16 and gate offset servo amplifier 24 allow the AC operation and DC operation of the circuit of FIG. 2 to be independent, because servo amplifier 24 supplies only a very low current, and does not change the offset capacitor voltage quickly. That is, servo amplifier 24 does not affect the high frequency AC feedback loop controlled by the error amplifier 12. Therefore, error amplifier 12 quickly drives $V_{AMPOUT}$ and hence $V_{GATE}$ to restore the proper value of regulated output voltage $V_{OUT}$ in response to a rapid change in $I_{OUT}$. At high frequencies, offset capacitor 16 appears as a short circuit and does not influence the loop. At low frequencies, offset capacitor 16 appears as an open circuit, and relies on servo amplifier 24 to maintain the proper DC offset voltage across offset capacitor 16.

Depending on the value of $VV_{REF}$, servo amplifier 24 controls the charge across offset capacitor 16 so as to prevent the output 15 of error amplifier 12 from "saturating" into either ground or voltage V1 on conductor 13A. To control the DC offset voltage across capacitor 16, servo amplifier 24 compares $V_{AMPOUT}$ to $VV_{REF}$, which is typically derived from the supply voltage V1. When $V_{AMPOUT}$ is higher than $VV_{REF}$, servo amplifier 24 sources a small amount of current into conductor 17, charging offset capacitor 16 to lower $V_{AMPOUT}$ until it reaches $VV_{REF}$ More precisely, $V_{GATE}$ rises slightly in response to servo amplifier 24, and the AC feedback loop quickly responds by appropriately lowering $V_{AMPOUT}$ so as to bring $V_{GATE}$ back to its proper value. When $V_{AMPOUT}$ is lower than $VV_{REF}$ the foregoing operation is reversed and continues until $V_{AMPOUT}$ rises to the value of $VV_{REF}$. Although $VV_{REF}$ preferably is variable as described herein, it could be set to a fixed value, such as $V_{IN}/2$.

$C_{OFFSET}$ is large enough to dominate the input capacitance of output transistor 18. Capacitor 16 and the input capacitance of output transistor 18 form a voltage divider that lowers the effective gain of the loop. The DC error of $V_{OUT}$ is still dominated by the input offset voltage of error amplifier 12. Since servo amplifier 24 operates to keep $V_{AMPOUT}$ mid-scale, variations in the DC error are eliminated, and systematic offsets may be reduced by designing error amplifier 12 appropriately. Servo amplifier 24 acts as a transconductance amplifier with a relatively small current output. It must consume as little current as possible from the charge pump output 25 in order to help minimize the size and noise contribution of charge pump 26B. One practical implementation of servo amplifier 24 is shown in FIG. 3.

Referring to FIG. 3, servo amplifier 24 includes input stage 39 and output current steering stage 40. Input stage 39 is a conventional differential amplifier front end circuit powered from the unregulated input voltage $V_{IN}$. Note that input stage 39 draws no current from charge pump 26B.

However, output current steering stage 40 draws its current from charge pump 26B.

Referring to FIG. 3, input stage 39 of servo amplifier 24 includes differentially connected P-channel input transistors M1 and M2 having their sources connected to one terminal of a constant current source $I_{BIAS}$. The other terminal of current source $I_{BIAS}$ is connected to $V_{IN}$. The gate of transistor M1 is connected by conductor 28 to receive the above mentioned variable reference voltage $VV_{REF}$, and the gate of transistor M2 is connected by conductor 15 to receive the error amplifier output signal $V_{AMPOUT}$. The drain of transistor M1 is connected to the drain of N-channel current mirror input transistor M3 and to the gates of both transistor M3 and N-channel current mirror output transistor M4. The sources of transistors M3 and M4 are connected to ground. The drains of transistors M2 and M4 are connected by conductor 41 to output stage 40.

Output stage 40 includes diode-connected N-channel transistor M8 which has its source connected to ground and its gate and drain connected to conductor 41. The gate of transistor M8 is connected to the gate of an N-channel transistor M9 having its source connected to ground and its drain connected to output conductor 17, which is connected to the gate of output transistor 18. Output stage 40 also includes N-channel transistor M5, which has its source connected to conductor 41 and its gate connected to a reference voltage equal to 1.5 times the threshold voltage $V_T$ of the N-channel transistors. The drain of transistor M5 is connected to the drain and gate of a P-channel current mirror input transistor M6 and the gate of a P-channel current mirror output transistor M7. The sources of transistors M6 and M7 are connected by conductor 25 to the output of charge pump 26B. The drain of transistor M7 is connected to output conductor 17.

When the two inputs of servo amplifier 24 are at equal voltages, the tail current $I_{BIAS}$ splits evenly between P-channel transistors M1 and M2. Therefore, no current flows to output conductor 17 from the charge pump supply ($V_{CP}$). However, when the (+) and (−) inputs of input stage 39 of servo amplifier 24 are not balanced, input stage 39 steers all or part of the tail current $I_{BIAS}$ through either transistor M1 or transistor M2.

For example, when $V_{AMPOUT}$ is lower than $VV_{REF}$, transistor M1 turns off. This turns off transistor M4, and $I_{BIAS}$ flows through transistor M2 and conductor 41 into diode-connected current mirror input transistor M8, which causes a corresponding mirrored current in the drain of transistor M9 to flow out of conductor 17. This reduces $V_{GATE}$, which slightly discharges the right terminal of offset capacitor 16.

However, when $V_{AMPOUT}$ is higher than $VV_{REF}$, $I_{BIAS}$ flows through transistors M1 and M3. This turns transistor M4 on, which turns transistors M8 and M9 off, and draws current from the source of transistor M5. This causes the current mirror transistors M6 and M7 to draw currents from charge pump output conductor 35. The mirrored current through transistor M7 therefore flows from charge pump output 25 through transistor M7 and conductor 17, increasing $V_{GATE}$ and charging offset capacitor 16.

If $V_{AMPOUT}$ is lower than $VV_{REF}$, then $I_{BIAS}$ turns transistors M8 and M9 on, and the drain current of M9 reduces $V_{GATE}$, and the output DMOS would be slightly turned off. This causes $V_{OUT}$ to decrease a few microvolts. The feedback voltage on conductor 21 follows the change in $V_{OUT}$ producing an error voltage between the inputs of error amplifier 12. That causes $V_{AMPOUT}$ to increase slightly until it equals $VV_{REF}$. In this way, servo amplifier 24 charges capacitor 16 so as to maintain the average voltage of $V_{AMPOUT}$ equal to the voltage of $VV_{REF}$. The feedback loop quickly corrects any errors in $V_{OUT}$.

Servo circuit 24 has a high power supply rejection ratio. The only element that couples noise from the charge pump output to $V_{GATE}$ is the P-channel current mirror including transistor M6 and transistor M7. Transistor M7 is the only device coupled to the charge pump output 25 and also to the gate of output transistor 18. Transistor M7 is a very small device which has a very small gate to drain capacitance. Capacitor 16 is very large. This capacitive divider behavior results in very little switching noise from the charge pump circuit appearing on the gate of output transistor 18 (especially compared to the amount of noise that would come through the error amplifier 12 if it were powered by the charge pump circuit). It has been found that when a spectrum analyzer is connected to conductor 19, no discernible noise from charge pump 26B appears in $V_{OUT}$. Charge pump circuit 26B is a conventional charge pump, which includes an internal oscillator that generates switching signals to control switches and capacitors operated to provide capacitive voltage boosting.

The maximum output current of the servo circuit is limited by $I_{BIAS}$ and the ratios of the current mirrors M6/M7 and M8/M9. Note that no current is drawn from charge pump output conductor 25 unless a positive charging current is flowing out of conductor 17 to charge up offset capacitor 16. This allows charge pump 26B to be a small economical circuit which does not require large voltage doubling capacitors.

In accordance with another aspect of the invention, the reference voltage applied on conductor 28 to the (−) input of gate offset servo amplifier 24 is controlled by variable reference voltage circuit 27. Variable reference voltage circuit 27 produces a variable reference voltage $VV_{REF}$ on conductor 28 in response to the current $I_{OUT}$ being supplied by output transistor 18.

Referring to FIG. 4, variable reference circuit 27 includes an input stage 27A and an output stage 27B. Input stage 27A includes differentially connected N-channel input transistors M13 and M14 having their sources connected to one terminal of a constant current source 51, the other terminal of which is connected to ground. The drain of transistor M13 is connected to the drain and gate of a P-channel current mirror input transistor M15 and to the gate of a P-channel current mirror output transistor M16. The sources of transistors M15 and M16 are connected to $V_{IN}$. The drain of transistor M16 is connected by conductor 50 to the gate and drain of transistor M14. The gate of transistor M13 is connected to receive an internally generated voltage $V_{IN}/2$ produced from $V_{IN}$ by means of a high impedance resistive voltage divider (not shown).

Conductor 50 is connected to output stage 27B of variable reference circuit 27. Output stage 27B includes N-channel transistor M11 having its source connected to conductor 50 and its drain and gate connected to a P-channel current mirror M17,M18. The gate of transistor M11 also is connected to the gate of an N-channel transistor M12 having its drain connected to $V_{IN}$ and its source connected by conductor 28 to one terminal of a constant current source 53 of value $I_{REF}$, the other terminal of which is connected to ground. Output stage 27B produces the variable reference voltage $VV_{REF}$ on conductor 28. The drain of transistor M11 is connected to the drain of a P-channel current mirror output transistor M18 having its source connected to $V_{IN}$ and its gate connected to the gate and drain of a P-channel current mirror input transistor M17. The source of transistor M17 is connected to $V_{IN}$. The gate and drain of transistor M17 are connected to conductor 29.

The current through conductor 29 and the drain of transistor M17 is a scaled representation of $I_{OUT}$, and is indicated in FIGS. 2 and 4 as having a value of $k_1 \cdot I_{OUT}$. The current $k_1 \cdot I_{OUT}$ is mirrored by transistors M17 and M18 to produce another scaled representation of $I_{OUT}$, indicated in FIG. 4 as $k_2 \cdot I_{OUT}$ flowing through the drains of transistors M18 and M11 into conductor 50.

$VV_{REF}$ is adjusted in response to $I_{OUT}$ in such a way as to provide a maximum dynamic range of LDO voltage regulator 10. For example, if output current $I_{OUT}$ is near a maximum acceptable value, then variable reference voltage $VV_{REF}$ should be as close to the unregulated input voltage $V_{IN}$ as possible. If there is a sudden decrease in current demanded by load 35, then $V_{GATE}$ can be rapidly decreased by error amplifier 12 from that high value to near ground, to correspondingly reduce the $V_{GS}$ voltage of transistor 18 and hence the output current $I_{OUT}$ being supplied thereby.

Similarly, when the output current $I_{OUT}$ initially demanded by load 35 is very low it is desirable for the output voltage $V_{AMPOUT}$ of the error amplifier to be fairly close to ground, so that $V_{AMPOUT}$ can rise from that low value to a high value and cause transistor 18 to be turned on very hard very fast to supply a large value of $I_{OUT}$ if load 35 suddenly demands a large current.

The gate of transistor M13 is connected to internally generated mid-rail voltage derived from $V_{IN}$. That voltage corresponds to a mid-level output current $I_{OUT}$. It is desirable that the error amplifier output of $V_{AMPOUT}$ be in the middle of its range at that point. The circuit needs to have a suitable range above and below that point.

$I_{OUT}$ feedback on conductor 29 needs to be applied to a P-channel current mirror, as shown in FIG. 4. Then current $k_2 \cdot I_{OUT}$ is a scaled representation of $I_{OUT}$. To first approximation, the voltage of conductor 50 remains constant. The $V_{GS}$ voltage of transistor M11 varies with current $k_2 \cdot I_{OUT}$ and hence with $I_{OUT}$. $I_{REF}$ is constant, so $VV_{REF}$ varies in the desired fashion as a function of $I_{OUT}$.

Referring to FIG. 4, the voltage divider that produces $V_{IN}/2$ (or other suitable mid-range reference voltage) is a high impedance reference. By taking the output of amplifier input stage 27A on conductor 50 and connecting it back to the gate of transistor M14 as an input, amplifier 27 provides low impedance on conductor 50, with the voltage on conductor 50 equal to $V_{IN}/2$. The impedance at conductor 50 is determined by transistors M14, M16, and current source 51. The purpose of amplifier 27A is simply to provide a low impedance $V_{IN}/2$ voltage reference circuit.

Stage 27B is the heart of the "smart" reference voltage circuit 27, and provides a variable reference voltage which is a function of $I_{OUT}$. If $k_2 \cdot I_{OUT}$ is equal to a mid-range value that produces the same current density in transistor M11 as $I_{REF}$ produces in transistor M12, then $V_{OUT}$ is centered about the mid-range value of $V_{IN}/2$. At that point, transistor M11 has a current density equal to that of transistor M12, so their $V_{GS}$ voltages are equal, and $VV_{REF}$ is equal to the voltage on conductor 50, which is $V_{IN}/2$. Transistors M11 and M12 are scaled such that their current densities are equal.

If $I_{OUT}$ increases from its midrange value, then transistor M11 is turned on harder to accept that current, and this causes its $V_{GS}$ voltage to increase. Since $I_{REF}$ is constant, the $V_{GS}$ voltage of transistor M12 is constant, so $VV_{REF}$ tracks the gate voltage of transistor M11. Therefore, as $I_{OUT}$ increases, $VV_{REF}$ also increases.

The voltage on conductor 50 remains relatively close to $V_{IN}/2$, although since it has a low impedance, an increase in $I_{OUT}$ produces a slight increase in the voltage on conductor 50. The slight variation in the voltage of conductor 50 is linear with respect to $I_{OUT}$, while the $V_{GS}$ voltage of transistor M11 has a square-law variation with respect to $I_{OUT}$.

It is desirable to have $VV_{REF}$ vary in a square law fashion because the current $I_{OUT}$ through output transistor 18 varies in a square law fashion with respect to its $V_{GS}$ voltage. The small linear component of $V_{OUT}$ due to the linear variation of the voltage on conductor 50 with respect to $I_{OUT}$ is negligible. Thus, $VV_{REF}$ has a square law deviation from its midpoint, as $I_{OUT}$ varies with respect to $I_{REF}$.

When $I_{OUT}$ has its maximum value, the $V_{GS}$ is voltage of transistor M11 is at its maximum value. Since the $V_{GS}$ voltage of transistor M12 is constant, $VV_{REF}$ also is at its maximum value. $VV_{REF}$ at maximum $I_{OUT}$ still does not go as high as $V_{IN}$, because it is desirable that the dropout transistor 18 to be able to be able to respond if there is still an increase in $I_{OUT}$. And the converse analysis is true if $I_{OUT}$ decreases to its minimum value.

This extends the dynamic response of LDO voltage regulator 10 without the need to increase the size of output transistor 18 or to increase the voltage V1 required to power the error amplifier 12. Instead, the described circuit exploits the separation of AC and DC paths in servo amplifier/offset capacitor configurations and modifies the DC operating point of error amplifier 12 to give it a maximum range for responding to rapid variations in $I_{OUT}$ using small transistors and without adding external pins or using noise-generating circuitry.

Since charge pump 26B need only replenish leakage currents from offset capacitor 16, the noise coupled by charge pump 26B onto $V_{IN}$ and $V_{OUT}$ is minimal. Since charge pump 26B is not used to power error amplifier 12, no noise is coupled from charge pump 26B through error amplifier 12 to its output $V_{AMPOUT}$. This simplifies the design of error amplifier 12 because high frequency PSRR is no longer a major concern. Full speed operation of error amplifier 12 is easily maintained because it is powered directly from V1.

While the invention has been described with reference to several particular embodiments thereof, those skilled in the art will be able to make the various modifications to the described embodiments of the invention without departing from the true spirit and scope of the invention. It is intended that all elements or steps which are insubstantially different or perform substantially the same function in substantially the same way to achieve the same result as what is claimed are within the scope of the invention. For example, the transistor types and the supply voltage polarities can be reversed.

What is claimed is:

1. A voltage regulator comprising:

(a) an error amplifier having a first input coupled to a first reference voltage, a second input receiving a feedback signal, and an output producing a first control signal;

(b) an output transistor having a gate, a drain coupled to an unregulated input voltage, and a source coupled to produce a regulated output voltage on an output conductor;

(c) a feedback circuit coupled between the output conductor and a third reference voltage, the feedback circuit producing the feedback signal;

(d) a capacitor coupled between the output of the error amplifier and the gate of the output transistor; and (e) a servo amplifier having a first input coupled to receive a second reference voltage, a second input coupled to the output of the error amplifier, and an output coupled to the gate of the output transistor to produce a second control signal thereon.

2. The voltage regulator of claim 1 including a low current charge pump circuit coupled to supply an output current into a supply voltage terminal of the servo amplifier.

3. The voltage regulator of claim 1 wherein the servo amplifier operates to maintain an offset voltage across the capacitor.

4. The voltage regulator of claim 2 wherein the servo amplifier operates to maintain an offset voltage across the capacitor.

5. The voltage regulator of claim 4 wherein the offset voltage is equal to the difference required between the first control signal and the second control signal to produce the desired regulated output voltage.

6. The voltage regulator of claim 1 including a variable reference voltage circuit producing the second reference voltage as a function of the amount of current flowing through the source of the output transistor.

7. The voltage regulator of claim 6 including an output current sensing circuit operative to produce a control signal representative of the drain current of the output transistor, the variable reference voltage circuit having an input coupled to receive the control signal.

8. The voltage regulator of claim 1 wherein the servo amplifier includes a first stage including a first transistor and a second transistor each having its source coupled to a bias current source, the first transistor having a gate coupled to the first input of the servo amplifier and a drain coupled to a gate and drain of a third transistor, the second transistor having a gate coupled to the second input of the servo amplifier and a drain coupled by a first conductor to a drain of a fourth transistor, the fourth transistor having a gate connected to the gate of the third transistor, the sources of the third and fourth transistors being connected to the third reference voltage, and a second stage including fifth, sixth, seventh, eighth, and ninth transistors, a gate of the fifth transistor being connected to a fourth reference voltage, a source of the fifth transistor being connected by the first conductor to a drain and gate of the eighth transistor and a gate of the ninth transistor, a drain of the fifth transistor being connected to a drain and gate of the sixth transistor and a gate of the seventh transistor, sources of the sixth and seventh transistors being coupled to receive the output current produced by the charge pump circuit, drains of the seventh and eighth transistors being coupled to the output of the servo amplifier, the sources of the eighth and ninth transistors being connected to the third reference voltage.

9. The voltage regulator of claim 8 wherein the first transistor, the second transistor, the sixth transistor and the seventh transistor are P-channel MOSFETs, and the third, fourth, fifth, eighth, and ninth transistors are N-channel MOSFETs.

10. The voltage regulator of claim 1 including a variable reference voltage circuit producing the second reference voltage as a function of the amount of current flowing in the source of the output transistor, and an output current sensing circuit including a current sensing transistor having its gate and drain connected to the gate and drain of the output transistor, a differential circuit responsive to a voltage difference between the sources of the output transistor and the current sensing transistor to produce a first control current which is a scaled representation of the current flowing through the source of the output transistor, and applying the scaled representation of the first control current as an input to the variable reference voltage circuit.

11. The voltage regulator of claim 10 wherein the variable reference voltage circuit includes a first stage including first, second, third and fourth transistors, the first and second transistors having sources coupled to a first reference current source, a gate of the first transistor being coupled to receive a mid-rail reference voltage, a drain of the first transistor being coupled to a gate and a drain of the third transistor and a gate of the fourth transistor, sources of the third and fourth transistors being coupled to the unregulated input voltage, a drain of the fourth transistor being coupled by a first conductor to a drain and gate of the second transistor, and a second stage including fifth and sixth transistors, a current mirror input transistor, and a current mirror output transistor, a source of the fifth transistor being coupled to the first conductor, a gate and drain of the fifth transistor and a gate of the sixth transistor being coupled to a drain of the current mirror output transistor, a gate of the current mirror output transistor being connected to a gate and drain of the current mirror input transistor, sources of the first and second current mirror transistors being coupled to the unregulated reference voltage, a drain of the current mirror input transistor conducting the scaled representation of the drain current of the output transistor, a drain of the sixth transistor being coupled to the unregulated input voltage, a source of the sixth transistor being coupled to produce the variable reference voltage on the output conductor, a second constant current source being coupled to the output conductor.

12. The voltage regulator of claim 11 wherein the first, second, fifth and sixth transistors are N-channel MOSFETs, and the third and fourth transistors, the current mirror input transistor and the current mirror output transistor are P-channel MOSFETs.

13. A method of providing a regulated output voltage, comprising:

(a) providing i. an error amplifier having a first input coupled to a first reference voltage, a second input receiving a feedback signal, and an output producing a first control signal, ii. an output transistor having a gate, a drain coupled to an unregulated input voltage, and a source coupled to produce a regulated output voltage on an output conductor;

iii. a feedback circuit coupled between the output conductor and a third reference voltage, the feedback circuit producing the feedback signal:, and (b) providing an offset voltage between the output of the error amplifier and the gate of the output transistor so as to separate the high current, high frequency path from the low current, low frequency path.

14. A method of providing a regulated output voltage, comprising:

(a) providing i. an error amplifier having a first input coupled to a first reference voltage, a second input receiving a feedback signal, and an output producing a first control signal, ii. an output transistor having a gate, a drain coupled to an unregulated input voltage, and a source coupled to produce a regulated output voltage on an output conductor;

iii. a feedback circuit coupled between the output conductor and a third reference voltage, the feedback circuit producing the feedback signal; and (b) providing an offset voltage between the output of the error amplifier and the gate of the output transistor so as to increase the amplitude of a voltage that can be applied to the gate of the output transistor without saturating the output of the error amplifier.

15. The method of claim 14 including performing step (b) by providing an offset capacitor coupled between the output of the error amplifier and the gate of the output transistor; and a servo amplifier having a first input coupled to receive a second reference voltage, a second input coupled to the output of the error amplifier, and an output coupled to the gate of the output transistor to produce a second control signal thereon.

16. The method of claim 14 including supplying a supply current into a supply voltage terminal of the servo amplifier by means of a low current charge pump circuit.

17. The method of claim 14 including operating the servo amplifier to maintain an offset voltage across the offset capacitor.

18. The method of claim 17 wherein the offset voltage is equal to the difference required between the first control signal and the second control signal to produce the desired regulated output voltage.

19. The method of claim 14 including providing a variable reference voltage circuit and operating the variable reference voltage circuit to produce the second reference voltage as a function of the amount of current flowing through the source of the output transistor.

20. The method of claim 14 including providing an output current sensing circuit and operating the output current sensing circuit to produce a control signal representative of the source current of the output transistor, the variable reference voltage circuit having an input coupled to receive the control signal.

21. The method of claim 14 including providing the servo amplifier outside of a high frequency AC feedback loop including and controlled by the error amplifier, in order to allow thc error amplifier to quickly change the gate voltage of the output transistor in response to an output overvoltage condition.

22. The method of claim 21 including operating the servo amplifier to cause the error amplifier to keep the first control signal near a mid-scale value.

23. The method of claim 16 including providing a small transistor in the servo amplifier to couple current from the charge pump circuit into the drain of the output transistor so as to isolate the output conductor from noise generated by the charge pump circuit.

24. The method of claim 16 including providing the charge pump circuit on an integrated circuit chip along with the error amplifier, the output transistor, the feedback circuit, capacitor, and the servo amplifier.

25. The method of claim 14 including operating the variable reference voltage circuit in response to the control signal representative of the drain current of the output transistor so as to prevent the error amplifier from saturating into a supply voltage rail.

26. The method of claim 25 including operating the variable reference voltage circuit to produce the second reference voltage at a value close to the unregulated input voltage if the drain current of the output transistor is near a maximum value, and to produce the second reference voltage at a value close to the third reference voltage if the drain current of the output transistor is near a minimum value.

* * * * *